US006174298B1

(12) United States Patent
Quinn et al.

(10) Patent No.: US 6,174,298 B1
(45) Date of Patent: Jan. 16, 2001

(54) MASSAGING ELEMENT AND A PORTABLE MASSAGER USING SAME

(76) Inventors: Gregory Quinn, 8001 Bay Parkway, Apt. 3E, Brooklyn, NY (US) 11214; Michael Leschinsky, 30 West Saddle River Rd., Waldwick, NJ (US) 07463

( * ) Notice: Under 35 U.S.C. 154(b), the term of this patent shall be extended for 0 days.

(21) Appl. No.: 09/256,385

(22) Filed: Feb. 24, 1999

(51) Int. Cl.[7] ..... A61H 7/00

(52) U.S. Cl. ..... 601/137; 601/97; 601/103; 601/136

(58) Field of Search ..... 601/97, 107, 108, 601/110, 111, 115–119, 122, 126, 128–130, 133–138, 121, 123, 125

(56) References Cited

U.S. PATENT DOCUMENTS

| | | | | |
|---|---|---|---|---|
| 1,161,767 | * | 11/1915 | Geraldine | 601/118 |
| 2,690,746 | * | 10/1954 | Achberger | 601/133 |
| 2,959,167 | * | 11/1960 | Leclabart | 601/133 |
| 3,616,793 | * | 11/1971 | Draper | 601/110 |
| 4,875,470 | | 10/1989 | Cotone . | |
| 4,984,568 | | 1/1991 | Persaud . | |
| 5,018,511 | * | 5/1991 | Yokoi | 601/84 |
| 5,020,518 | | 6/1991 | Spears | 601/116 |
| 5,078,125 | | 1/1992 | Schumacher . | |
| 5,094,225 | | 3/1992 | Craw . | |
| 5,233,973 | | 8/1993 | Gill | 601/103 |
| 5,348,529 | | 9/1994 | Veltri | 601/99 |

FOREIGN PATENT DOCUMENTS

| | | | | |
|---|---|---|---|---|
| 393353 | * | 4/1924 | (DE) | 601/133 |
| 468838 | * | 7/1914 | (FR) | 601/133 |
| 533487 | * | 3/1922 | (FR) | 601/133 |
| 442105 | * | 2/1936 | (GB) | 601/133 |

* cited by examiner

*Primary Examiner*—Justine R. Yu
(74) *Attorney, Agent, or Firm*—Boris Leschinsky

(57) ABSTRACT

A massaging element for delivering a long stroke massage, the massaging element having at least one pair of symmetrical arc-shaped spring elements extending from a central driving component and having replaceable massaging units such as rollers at their free ends. A driving unit delivers reciprocating motions to the central driving component causing compressing and outward movements of the massaging units. A power or manually driven massager incorporates a plurality of the massaging elements for a wide area massage of the patient's body. The massager is easily foldable for storage or transport.

2 Claims, 3 Drawing Sheets

MASSAGING ELEMENT AND A PORTABLE MASSAGER USING SAME

BACKGROUND OF THE INVENTION

1. Field of the Invention

The present invention relates generally to devices to induce a massaging motion over a certain area of the patient's body. In particular, the device of the present invention relates to back massagers of the type simulating the long stroke massaging motions given by a professional massage therapist.

2. Description of the Prior Art

The word "massage" generally describes a variety of motions over the patient's body such as rubbing over the skin, rumpling the muscles, slapping or rapping and pressing over various portions of the patient's body so as to eliminate venous congestion, to stimulate arterial circulation, and to intensify metabolism in various tissues. Although a massage can be performed manually by another person, various devices have been described in the prior art that would be either of assistance to the person performing a massage or allow the patient to induce a massage onto himself without the help of others. Specifically, such devices have been proposed for the massage of the patient's back.

The area of the patient's back presents a special interest for a massaging therapy. Complains of a "back pain", especially in the lumbar region, are quite common. In fact, in some cases they can cause severe pains and even become debilitating. It is believed that periodic applications of a massaging therapy can stimulate more blood to flow to these areas and therefore relieve these symptoms. On the other hand, as opposed to other portions of the body, the back is difficult to reach for the patient himself. Therefore, there is a need for either professional assistance or an apparatus allowing the patient to apply a massage to the back of the body.

A large variety of massagers and massaging devices have been proposed for these purposes. They generally can be divided into two groups. The first one consists of small hand-held devices inducing high frequency vibrations over a limited area of the skin. Although inexpensive and portable, these devices do not allow for a deep massage of the tissue such as what can be given by a professional massage therapist. The second group consists of rather complex back massage devices typically incorporated in a piece of furniture such as a chair or a bed.

Various chair-type massaging devices are suggested in U.S. Pat. No. 5,348,529 by Veltri, U.S. Pat. No. 5,233,973 by Gill, and U.S. Pat. No. 5,020,518 by Spears. These devices of various levels of complexity are typically incorporated in a chair and provide a massaging action by moving a singe or several pairs of rollers up and down the patient's back while the patient is sitting in the chair. In addition to being complex and not portable, these devices do not allow for the change in the direction of a massaging action or the change in the force applied to various parts of the back.

Another version of the chair attachment is suggested in the U.S. Pat. No. 5,018,511 by Yokoi. Elongated plate members having massaging protrusions with optional leaf springs are described in this U.S. patent as the basis of the massaging apparatus. Reciprocating movements of the plate members cause high frequency vibrational massage to be applied to the patient's back or other portions of the body held against the apparatus. This apparatus does not have provisions for a deep long stroke massage of the patient's back wherein the massaging protrusions can move slowly along a substantial portion of the skin rather then frequently hitting a limited area of the skin. In addition, this device is quite large and can not be easily folded for storage.

Several bed-type back massaging devices are described in U.S. Pat. No. 5,078,125 by Schumacher, U.S. Pat. No. 4,984,568 by Persaud, and U.S. Pat. No. 4,875,470 by Cotone. These devices generally comprise a massaging robotic arm attached to a driving apparatus which in turn is located in the vicinity of the patient's bed. Although allowing for various useful long stroke massaging motions, these devices are extremely complex and have to be permanently attached to the vicinity of the patient's bed.

The need therefore exists for a simple massaging apparatus with a massaging element allowing for a long stroke deep skin massage especially over the patient's back. Such apparatus should allow the patient to administer massage onto himself easily and, at the same time, the massager should be both foldable and portable so as to allow the use in various circumstances, such as at home, in a car or a truck, in a hospital, in a gym, and alike.

SUMMARY OF THE INVENTION

Accordingly, it is an object of the present invention to overcome these and other drawbacks of the prior art by providing a novel massaging element and a simple massager device utilizing this element for delivering a long stroke back massage.

It is another object of the present invention to provide a massaging element and a massager using same, such massager operable manually or from a powered drive.

It is a further object of the present invention to provide a portable massager using the massaging element of the present invention, such massager being easily transportable to be used in various environments such as at home, in a vehicle, in a hospital, in a gym, and alike.

The present invention is based on a principle schematically illustrated on FIGS. 1A and 1B. The massaging element of the present invention contains at least one pair of symmetrical arc-shaped spring elements (12) and (13) attached at the top to a central driving component (11). These spring elements may be a leaf spring or a flat spring as well as other types of springs. They may also have variable flexibility along their length. At their free ends at the bottom, the spring elements (12) and (13) are equipped with massaging units (14) and (15) respectively, such as rollers illustrated on the drawings. Quick disconnect couplings (not shown) of any known type allow for easy replacement of the rollers for other massaging units such as rollers of other shapes, as well as brushes, protrusions, massaging fingers and other types commonly used for massaging purposes to change the type of a massage given to the patient. Manual or mechanized reciprocating movements of the central driving component (11) cause the massaging units (14) and (15) to move outwardly while compressing and massaging the skin of the patient. The massaging action therefore is delivered by both compressing and rolling motions over the patient's skin.

More than one pair of spring elements can also be used in a massaging element. Those skilled in the art would readily appreciate the possibility of having multiple pairs extending radially from the central driving element to allow for a radial massage over a larger area of the skin. Various lengths of the spring elements would allow to change the coverage area of the massaging element. The force of the massage can be easily adjusted by varying the initial position of the central driving element. Lowering the initial position in accordance with the drawings will increase the intensity of the massage, while lifting it up would decrease it respectively.

Another possibility of adjustments would be the rotation of the direction of outward movements. FIGS. 1A and 1B show lateral massage of the patient's back. A simple ¼ turn would allow for change to a longitudinal massage as well.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1B:
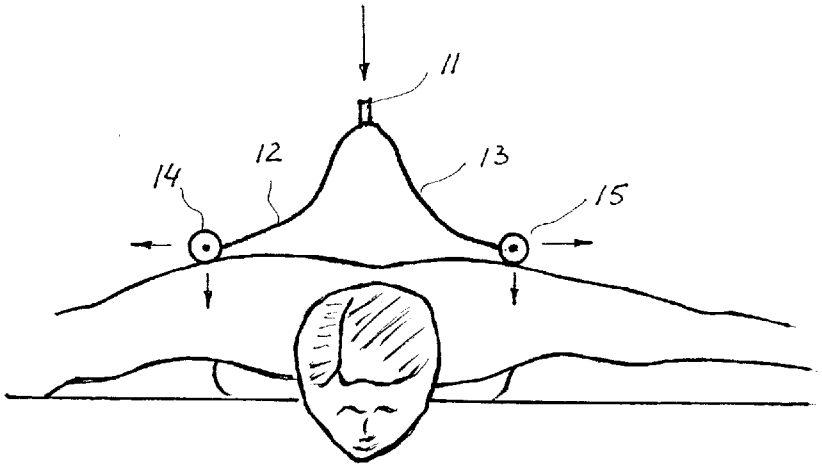
FIGS. 1A and 1B are the schematic representation of the principle behind the massaging element of the present invention.
Figure 1A:
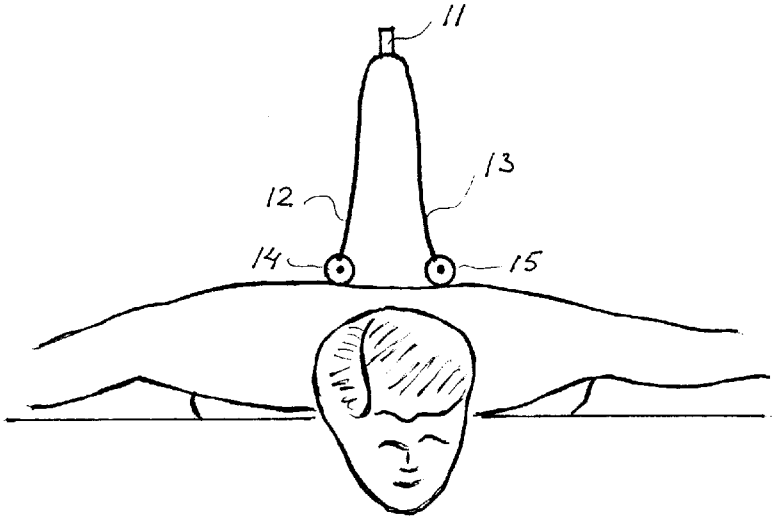
Figure 2:
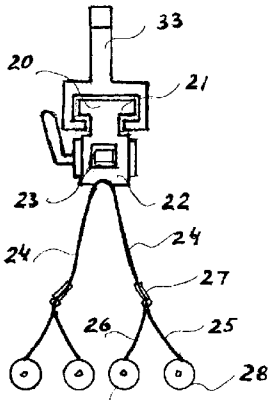
FIG. 2 is a side view of the massaging element in accordance with the preferred embodiment of the invention.

FIG. 2 illustrates the preferred design of the massaging element (20) of the present invention. It may contain one or several sections (21) placed in parallel on the common shaft (23). This shaft has a shape which is not round in cross-section and may be a square as shown on the figure. Multiple sections (21) have a corresponding square opening in the housing (22) to be placed over the shaft (23) without the possibility of rotation. Each of the sections (21) contains at least one pair of symmetrical spring elements (24) attached at the top to the housing (22). At the bottom, each of the spring elements (24) is terminated with a joint component (27) allowing for attachment of the massaging springs (26) and (25) with the possibility of rotation around the axis contained at the bottom of each spring element (24). The purpose of having the massaging springs (25) and (26) is to eliminate the "dead zones" where no massage can be performed in case of using just the spring elements (24) alone. The presence of additional massaging springs (25) and (26) with attached massaging units (28) allow for a full coverage of the area desirable for a massage therapy.

Massaging units (28) are attached to the proximal ends of the massaging springs (25) and (26) and are shown on the drawings as simple rollers. Provisions are made for a quick disconnect couplings to allow for easy replacement of the massage units for other massage units to vary the type of massaging action (not shown). Rollers of various shapes, lengths and diameters as well as made from various materials with optional rubber coatings including these with additional protrusions may be used as such massaging units along with other designs commonly known in the art such as massage brushes, massage fingers and alike.

A manual operation of the massaging element is envisioned by attaching a holder (33) over the housing (22). Manually induced reciprocating motions of the massaging element (20) over the skin of the patient would cause the plurality of massaging units (28) to massage the area of the skin located under the massaging element in a manner similar to that of a professional massage therapist.

Figure 6:
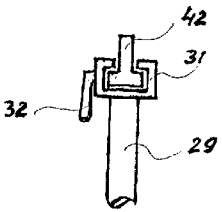
FIG. 6 is a top view of the detailed illustration of the holder for the massaging element; and finally
Figure 3:
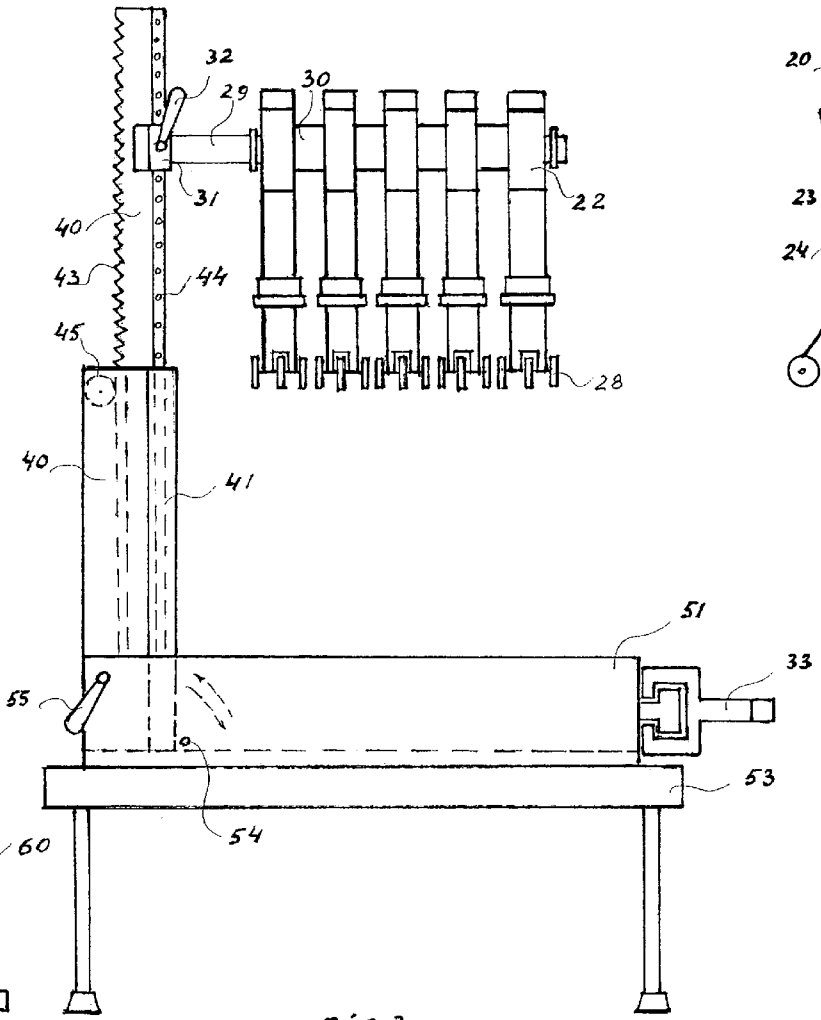
FIG. 3 is a front view of the massager in a working position using the massaging element of the invention and mounted on a patient's bed.

A power-driven but still portable version of the massager using the massaging element according to the present invention is shown on FIG. 3. A plurality of massaging sections (22) are placed with optional spacers (30) over a common holding shaft (29). In turn, the holding shaft (29) is attached via the adjustable clamp (31) to the reciprocating T-shaped column (42) of a driving unit (40). The clamp (31) allows the holding shaft (29) to be moved along the column (42) by loosening and subsequent tightening of a clamp lever (32) along the adjustment holes (44) to adjust the massaging force, as shown on FIG. 6.

The driving unit (40) contains a T-shaped housing (41) to accept the reciprocating column (42) and a driving motor/gear mechanism (not shown) to activate the rotations of the driving gear (45) which in turn is engaged with the gear teeth (43) along the column (42). Driving unit (40) causes the holding shaft (29) to move periodically closer and further way from the patient which in turn causes massaging units (28) to stimulate the area of the skin located below.

Figures 4, 5:
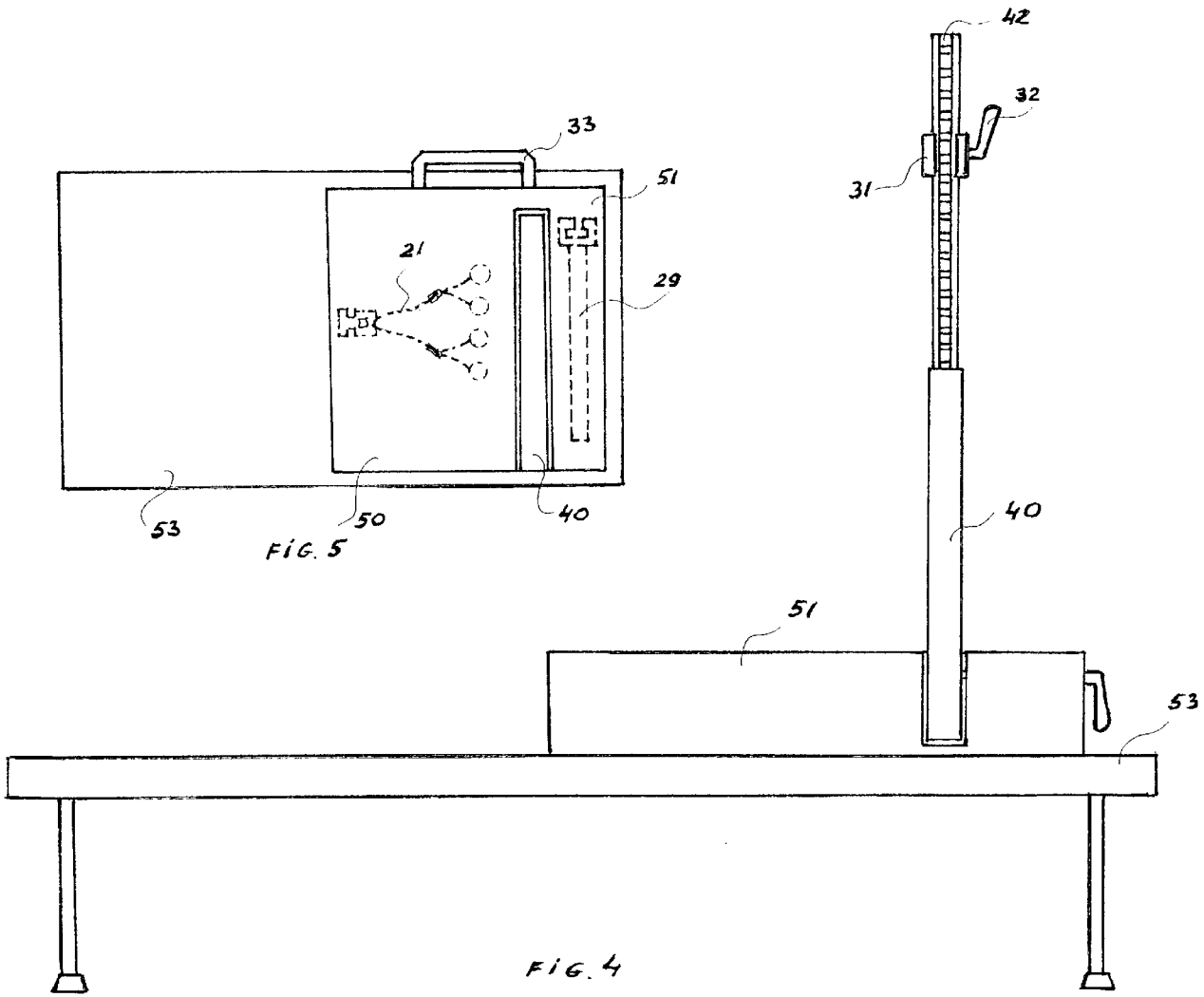
FIG. 4 is a side view of the same device, massaging element is not shown.
FIG. 5 is a reduced view of the massager of the present invention being folded for transport or storage.

Provisions are made to provide a housing (51) to contain all components of the massager of the present invention in the folded position for storage and transport as shown on FIG. 5. The housing (51) contains a holder (33) which optionally may also be used as a holder for manual operation of the massaging element as described above.

FIGS. 3 and 4 illustrate the working position of the massager, placed for example over a bed (53), where the driving unit (40) is turned up around the axis (54) and fixed in place with the clamp (55). The patient is placed over the top surface of the housing (51) while the height of the holding shaft (29) is at a maximum. Quick adjustment of that height brings the massaging units (28) in direct contact with the patient's body. Activation of the driving unit (40) causes the column (42) to move reciprocally up and down and in turn causing the long stroke massage of the patient.

Figure 7:
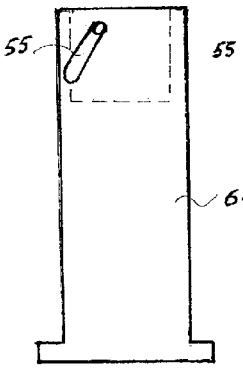
FIG. 7 is an illustration of an alternate base for the massager of the present invention.

A stationary version of the massager is also envisioned, for example for use in a hospital. In that case, a base (60) as shown on FIG. 7 is needed to both house the components of the massager and also to serve as a foundation for the driving unit (40).

Although the present invention has been described with respect to several specific embodiments and applications, it is not limited thereto. Numerous variations and modifications readily will be appreciated by those skilled in the art and are intended to be included within the scope of the present invention, which is recited in the following claims.

We claim:

1. A massaging element for delivering a long stroke massage, said element comprising:

a central driving means for providing reciprocating motion, a first primary spring element and a second primary spring element, each primary spring element having a first end and a second end, said first and second primary spring elements attached to said central driving means at their respective first ends, a first secondary spring and a second secondary spring, each of said secondary springs having a first leg, a midpoint, and a symmetrical second leg; said first secondary spring pivotally attached at its midpoint to said second end of said first primary spring element; said second secondary spring pivotally attached at its respective midpoint to said second end of said second primary spring element, and four replaceable massaging units, each massaging unit attached to the respective first or second leg of said first and second secondary springs, whereby compressing and outward reciprocal movements of said first and second spring elements together with respective compressing and reciprocal movements of said secondary springs causing a long stroke massage by said massaging units without a blind zone.

2. A portable massager for delivering a long stroke massage, said massager comprising:

at least one massaging element comprising a central driving means for providing reciprocating motion; a first primary spring element and a second primary spring element, each primary spring element having a first end and a second end, said first and second primary spring elements attached to said central driving means at their respective first ends; a first secondary spring and a second secondary spring, each of said secondary springs having a first leg, a midpoint, and a symmetrical second leg, said first secondary spring pivotally attached at its midpoint to said second end of said first primary spring element, said second secondary spring pivotally attached at its respective midpoint to said second end of said second primary spring element; and four replaceable massaging units, each massaging unit attached to the respective first or second leg of said first and second secondary springs, and a means for reciprocally moving said central driving means, whereby compressing and outward reciprocal movements of said first and second spring elements together with respective compressing and reciprocal movements of said secondary springs causing a long stroke massage by said massaging units without a blind zone.

* * * * *